United States Patent [19]

Clay et al.

[11] Patent Number: 4,619,732

[45] Date of Patent: Oct. 28, 1986

[54] METHOD FOR DRYING PULPING LIQUOR TO A BURNABLE SOLID

[75] Inventors: David T. Clay; Timothy B. Cartwright, both of Appleton, Wis.

[73] Assignee: The Institute of Paper Chemistry, Appleton, Wis.

[21] Appl. No.: 759,085

[22] Filed: Jul. 25, 1985

Related U.S. Application Data

[63] Continuation-in-part of Ser. No. 557,604, Dec. 2, 1983, abandoned.

[51] Int. Cl.[4] ..... D21C 11/00; D21C 11/10

[52] U.S. Cl. ..... 162/29; 34/10; 162/30.1; 162/30.11; 162/47

[58] Field of Search ..... 162/29, 30.1, 30.11, 162/47, 240; 423/DIG. 3, 207, 206; 159/47.3; 34/10, 57 A; 422/185

[56] References Cited

U.S. PATENT DOCUMENTS

| | | | |
|---|---|---|---|
| 3,053,615 | 9/1962 | Steinert | 422/185 |
| 3,322,492 | 5/1967 | Flood | 162/30.1 |
| 3,657,064 | 4/1972 | Shick | 162/30.1 |
| 3,674,630 | 7/1972 | Copeland | 162/30.11 |
| 4,135,968 | 1/1979 | Dehaas | 162/30.1 |
| 4,245,395 | 1/1981 | Potter | 34/10 |
| 4,284,416 | 8/1981 | Nahas | 48/197 R |
| 4,295,281 | 10/1981 | Potter | 34/10 |
| 4,363,698 | 12/1982 | Nelson et al. | 162/30.1 |
| 4,377,439 | 3/1983 | Liem | 162/30.1 |

FOREIGN PATENT DOCUMENTS

| | | | |
|---|---|---|---|
| 149593 | 9/1982 | Japan | 162/30.11 |

*Primary Examiner*—Kenneth M. Schor
*Assistant Examiner*—K. M. Hastings
*Attorney, Agent, or Firm*—Fitch, Even, Tabin & Flannery

[57] ABSTRACT

Pulping liquor, which has been pre-concentrated to at least 50 weight percent solids, is dried in a fluidized bed dryer to produce a solid in particulate form. In the fluidized bed dryer, pre-formed particulates are fluidized by a gaseous medium substantially of superheated, unsaturated steam, and additional heat is supplied to the fluidized bed by higher pressure saturated steam passing through heat-exchange tubing within the fluidized bed region. Pulping liquor is introduced into the fluidized bed where the superheated steam vaporizes a substantial portion of its water content. The fluidizing steam becomes substantially saturated during its passage through the region of the fluidized bed, and a substantial portion of this substantially saturated steam is used upstream to pre-concentrate the pulping liquor. The solid particulates that are continuously withdrawn from the region of the bed have several advantages relative to a pulping liquor as a fuel for a pulping chemical recovery furnace, including increased thermal efficiency and storability until time of use.

9 Claims, 3 Drawing Figures

MULTIPLE EFFECT EVAPORATOR
CONCENTRATOR
STEAM
RECOVERY FURNACE
B.D. & S.S.
SMELT

METHOD FOR DRYING PULPING LIQUOR TO A BURNABLE SOLID

This Application is a continuation-in-part of U.S. patent application Ser. No. 557,604, filed Dec. 2, 1983, now abandoned.

The present invention relates generally to pulping liquor recovery methods and more particularly to a method in which pulping liquor is dried to a solid prior to its introduction into a recovery furnace.

BACKGROUND OF THE INVENTION

A common process for producing pulp from wood is the Kraft process in which the wood is cooked with sodium sulfide and sodium hydroxide. Efficient pulping requires that the pulping chemicals be recovered from the spent pulping liquor or "black liquor". Recovery is conventionally achieved by concentrating the liquor and then burning it in liquid form in a recovery furnace. The resulting ash or smelt is recovered from the furnace and converted by conventional techniques for reuse in the pulping process.

A major capital investment in a pulping liquor recovery system is the recovery furnace. Each furnace has a maximum heat capacity which places an upper limit on the throughput rate of a given material. The throughput rate cannot ordinarily be incrementally increased, and when the capacity of the furnace is reached, it becomes a limiting factor in the recovery system, so that it is then necessary to replace the furnace with a larger one. Thus, a process which permits increased throughput capacity for an installed recovery furnace is highly desirable.

Pulping liquor is typically concentrated to between 60 and 70 weight percent solids, and in some of the more modern systems to about 75 weight percent solids, for burning in a recovery furnace. In all cases, the significant water content of the liquor reduces the amount of useable heat that is produced by the recovery furnace. The water vapor from the liquor is usually discharged with the flue gas, resulting in the substantial loss of heat, as sensible and latent, from the system.

A further limitation to a system which burns pulping liquor in liquid form is that the concentrated liquor is not inexpensively stored and must be burned in a recovery furnace when it is concentrated. The recovery furnace must have sufficient throughput capacity to accommodate the pulping liquor that is produced and concentrated at peak times, meaning that at other times, the furnace operates at less than capacity. If a system could be adapted to accommodate the average amount of a concentrated pulping liquor available rather than the peak amount, a smaller, less expensive recovery furnace could be used.

Further reducing the water content of the pulping liquor until a handleable solid remains would be advantageous in several respects. The substantially reduced water content would minimize all of the above-described disadvantages of vaporizing water in a recovery furnace. Furthermore, a solid, in certain forms, can be stored and supplied to a recovery furnace as required, whereby the operation of the recovery furnace is not tied to the operation of the liquor concentrating apparatus and the solid may be supplied to a recovery furnace at a generally constant rate that is independent of the rate of solid production.

At the present time, there is no method commercially available or in industrial use for drying pulping liquor efficiently to a solid. As the pulping liquor changes from a liquid to a solid, it becomes very viscous and would clog up any apparatus which would remove additional water from the liquor in the manner of an evaporator or a concentrator. Furthermore, the solid must be provided in a form that is burnable in a recovery furnace, and preferably in a form providing substantial exposed surface area for more efficient burning.

Accordingly, it is a primary object of the present invention to provide a method for drying pulping liquor to a burnable solid form, specifically in a particulate form. It is also an object of the invention to provide a method in which energy expended in the drying apparatus is efficiently conserved to be used for initial concentrating of the liquor.

In accordance with the present invention, pulping liquor is dried to form pulping liquor solid particulates in a method utilizing a fluidized bed dryer in which superheated steam serves as the fluidizing and drying gaseous medium. Although the invention is described primarily in terms of drying black liquor from a Kraft process, the process is applicable to drying liquor from other pulping processes, such as soda liquor, where dehydration produces a burnable, but steam-interactive solid.

U.S. Pat. No. 4,377,439 describes a process in which inorganic particulates from the recovery furnace are supplied to a coater dryer, where, in a fluidized bed, pulping liquor is coated and dried thereon. The coated particles are then returned to the recovery furnace. The fluidizing and drying medium, in this case, is flue gas. This process produces solid particulates with non-burnable cores and burnable outer coatings. It requires the continuous transfer of the inorganic mass between the recovery furnace and the fluidized bed dryer, which is inherently energy inefficient.

U.S. Pat. No. 4,295,281 describes drying brown coal particulates in a fluidized bed dryer using superheated steam as the fluidizing and drying medium.

The dry flue gas used in the above-mentioned U.S. Pat. No. 4,377,439 is substantially non-interactive with the black liquor and the black liquor solid particulates that are being dried with flue gas. Similarly, the superheated steam used in the above-mentioned U.S. Pat. No. 4,295,281 is substantially non-interactive with the coal particulates. These patents do not teach conditions which are required for drying pulping liquor to burnable, but steam-interactive particles. They do not teach, for example, the effect of alkali content on permissible operating temperature in a fluidized bed dryer. They do not teach velocities of fluidizing steam which must be maintained to fluidize particles that are tacky due to interaction with steam.

In contrast, steam is substantially interactive with pulping liquor and pulping liquor solid particulates, creating difficulties in maintaining a fluidized bed. Specifically, the steam can interact to make the dried pulping liquor particulates tacky so that they have a tendency to agglomerate. Also, while it is necessary to provide a sufficiently high temperature to boil water from the pulping liquor, higher temperatures initiate pyrolysis of the pulping liquor, which pyrolysis also tends to agglomerate particulates. Accordingly, the invention provides specific parameters for operation of a dryer wherein a fluidized bed of pulping liquor and pulping liquor solid particulates is maintained using superheated steam as the fluidizing and drying gaseous medium.

SUMMARY OF THE INVENTION

In the method of the invention, pulping liquor is pre-concentrated either to about 50% solids or above in an evaporator or to about 65% solids or above in an evaporator and a concentrator. The pre-concentrated liquor is then dried by fluidizing to form a solid in particulate form that is suitable for subsequent combustion in a conventional recovery furnace. A fluidized bed is initially formed of previously formed particulates which are fluidized by an upwardly-flowing stream predominantely or totally of dry steam. Substantial additional heat is supplied to the fluidized bed by heat transfer means in the bed. This additional heat vaporizes water from the pre-concentrated pulping liquor introduced into the fluidized bed, creating additional particulate material and lowering the steam superheat above the fluidized bed. The steam superheat is close to the boiling point rise of the particulate matter. The steam and particulate matter (pulping liquor solids) are substantially in equilibrium. A portion of steam is elevated to its original superheat and returned to the bed as a fluidizing stream while the remainder of the steam is directed to a concentrator or evaporator where its latent heat of vaporization is used for pre-concentrating the liquor. The steam flow to the pre-concentrating process is substantially equal to the water flow into the dryer.

In order to sustain a fluidized bed of pulping liquor and pulping liquor solid particulates, specific conditions need to be maintained in the dryer where the pulping liquor solids are being dried in the presence of steam, which has substantial interaction with the pulping liquor materials. In particular, the temperature in the dryer must be maintained between about 245° F. and about 390° F. and the pressure between 40 and about 70 psig, the temperature and pressure being such that water boils from the pulping liquor material.

DETAILED DESCRIPTION OF THE PREFERRED EMBODIMENTS

Figures 1, 2, 3:
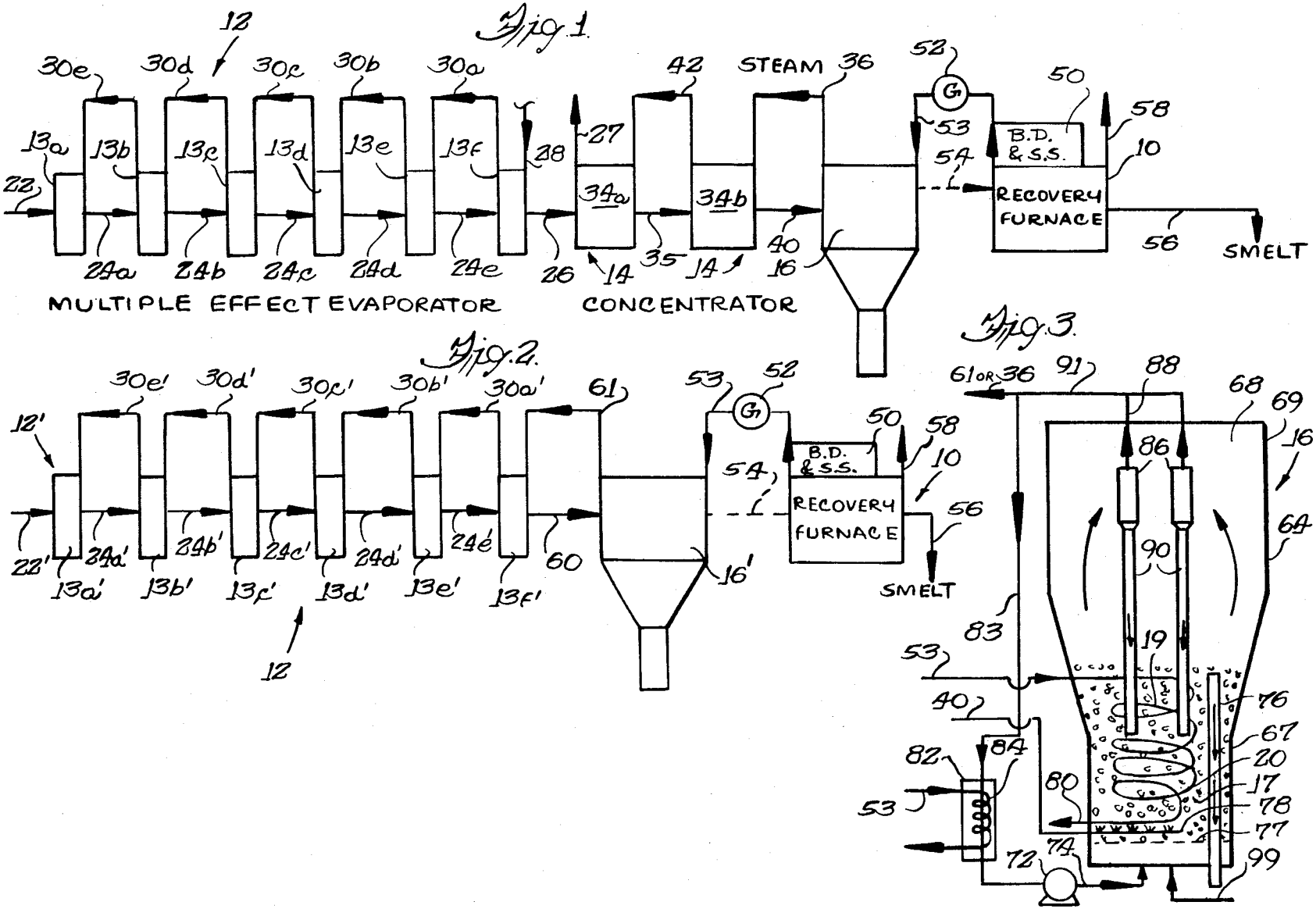
FIG. 1 is a schematic diagram of a pulping liquor recovery system in which pulping liquor is converted from a low solids content liquid to a burnable solid and then burned in a recovery furnace.
FIG. 2 is a schematic diagram of an alternate pulping liquor recovery system.
FIG. 3 is a diagrammatic illustration of the fluidized dryer employed in the systems shown in FIGS. 1 and 2.

In accordance with the present invention, method is provided for converting pulping liquor from a pulping process, typically containing between about 15 and about 18 weight percent solids, to a non-tacky solid having about 90 weight percent solids or more, i.e., a water content of 10% or less. The solid is employed to fuel a recovery furnace 10 which, in burning the organic components of the pulping liquor, converts the inorganic components to chemicals that are usable in the pulping process.

Dilute pulping liquor is initially concentrated in a multiple effect evaporator 12, further concentrated in a concentrator 14, if desired, and reduced in water content to produce solid particulates in a dryer 16. A fluidized bed 17 is initially established in a region 67 within the dryer and comprises previously formed pulping liquor solid particulates which are fluidized by upwardly flowing gaseous medium, that is predominately dry steam obtained by superheating steam. The principal heat that dries the liquor in the fluidized bed 17 is provided by steam at about 400–500 psig, which flows through heat exchange means 19 comprising tubing/-plates 20 embedded in the bed 17 (FIG. 3). Heat is transferred to the pre-formed particulates and to the incoming pre-concentrated pulping liquor, drying the liquor to create additional solid particulates. In drying the liquor, water vapor emitted from the pre-concentrated pulping liquor combines with the fluidizing medium (steam) to lower its superheat. A portion of the lower superheat steam is recirculated through line 83 to the fluidized bed 17 of the dryer 16 while another portion (that passing through lines 36 and 61) is used to concentrate the liquor in the evaporator 12 and/or in the concentrator 14.

In the system illustrated in FIG. 1, pulping liquor, containing about 15% to about 18% solids, passes through several similar effects **13*a*–13*f* (six effects being shown in the drawing) of the multiple effect evaporator 12 where relatively low pressure (low temperature) steam is used to evaporate water from the pulping liquor. In FIG. 1, the pulping liquor flows from left to right, entering the left-hand effect 13*a* through line 22 and flowing to successive effects through lines 24*a* to 24*e* before exiting the last effect 13*f* at about 55% solids through line 26. Low pressure steam which originates from a boiler drum and superheater section 50 associated with the furnace 10, but which has given up much of its energy in processes that require high quality steam, is passed through line 28 to the evaporator 12 where it is used to pre-concentrate the liquor. The steam flowing through line 28 indirectly heats the pulping liquor in the right hand (downstream) effect 13*f* and steam (contaminated vapor) from the right hand effect is conducted through line 30*a* to the effect 13*e* to its left. The steps are repeated, steam produced in each successive effect 13*e*–13*b* conducted through lines 30*b*–30*e* to heat liquor counter-currently in the multiple effect evaporator 12. The final steam 30*f*** is sent to a condenser (not shown).

The partially concentrated (55% solids) liquor conducted through line 26 is introduced into the concentrator 14 where, through further evaporation, the solids content is increased from about 55% to about 65–75%. The illustrated concentrator 14 is a two-body concentrator through which, in FIG. 1, liquor flows from left to right through a first body **34*a*, through line 35 to a second body 34*b* and out through line 40 to the dryer 16. The liquor flow can also be reversed, going first to 34*b* then to 34*a* and out to the dryer 16. The bodies 34*a* and 34*b* of the concentrator 14 are similar in operation to the operation of the effects 13*a*–13*f* of the evaporator 12. Thus, incoming steam in each body heats the pulping liquor therein, removing water as steam from the pulping liquor. Steam flowing through line 36 from the dryer 16 enters the second body 34*b* where it serves to remove water as steam from liquor therein. This steam is conducted through line 42 to the first body 34*a* where it removes water as steam from the upstream pulping liquor. This steam, in turn, is conducted through line 27** to a vapor condenser or waste heat evaporator (not shown).

The heat for drying liquor in the dryer 16 is provided by steam from the boiler drum and superheater section 50. Because of the high heat generated in the recovery furnace 10, high pressure superheated steam, typically at or above 900 psig, is generated in the boiler drum and superheater section 50. Superheated steam of such high pressure has significant value, and a portion of the heat is typically utilized for other processes, such as running an electrical generator 52. The close to saturated steam exiting the generator through line 53 is at medium pressure, e.g., about 400–500 psig; saturated steam of such pressure still containing sufficient heat to dry the pre-concentrated liquor to a solid in the dryer 16.

Transfer of solid particulates from the dryer 16 to the recovery furnace 10 is represented by a dotted line 54, indicating that the particulate matter need not be transfered directly or immediately from the dryer 16 to the recovery furnace 10. The solid particulates are transfered to the recovery furnace 10 as required to generally maintain the furnace at peak throughput capacity, and excess solid particulates may be stored until needed. The ability to store the excess solid particulates represents a significant advantage of drying pulping liquor, as this permits more full utilization of a recovery furnace 10 which typically represents the most expensive piece of apparatus in a pulping chemical recovery system.

The ash or smelt resulting from combustion of the solid particulates, represented in the drawings by line 56 as exiting the lower end of the recovery furnace 10, represents the chemicals which can be recycled to the pulping process.

The other product of the recovery furnace is flue gas which exits through a flue or chimney, represented at 58. Although some heat may be recovered from the flue gas through appropriate heat exchangers associated with the flue 58, the flue gas represents a loss of heat from the system. Among the advantages of a system which converts pulping liquor to solid particulates is that the flue gas resulting from combustion of a substantially dry solid contains much less water vapor than does flue gas produced in a conventional process where concentrated pulping liquor having significant water content is burned in the recovery furnace 10. A conventional process typically burns liquor having a water content of 30–35%, whereas the solid particulates contain about 10% water or less and usually less than 1%. As water has a very substantial heat of vaporization, the reduction in water vapor content in the flue gas, resulting from increased drying of the solids, represents a considerable reduction in wasted energy.

Illustrated in FIG. 2 is an alternate system embodying various features of the present invention. In this embodiment, no concentrator 14 is used, and pulping liquor at about about 50 to 55 percent solids is transferred directly from the evaporator 12' to the dryer 16' through line 60, while saturated steam from the dryer is transferred directly through line 61 to the last effect **13*f*' of the multiple effect evaporator 12'**.

There is no significant difference between the dryer 16 of the system shown in FIG. 1 and the dryer 16' of the system shown in FIG. 2 except that in the FIG. 2 system, a larger dryer (or additional drying units) is used to remove the additional water contained in the less-concentrated incoming pulping liquor. Like parts of the evaporator 12' to the evaporator 12 are indicated by the same numbers but differentiated by the symbol prime (′). Selection of the system shown in FIG. 1 or the system shown in FIG. 2 depends upon the relative costs of the two systems, and an independent cost analysis must be made for each particular system. If a concentrator 14 is already available in a plant, the FIG. 1 embodiment may be preferred as a smaller, less expensive dryer may be added to the system.

A dryer 16, embodying various features of the present invention, is shown in greater detail in FIG. 3. The dryer 16 consists of a large chamber 64 in which the fluidized bed 17 of particulates is maintained in a lower region 67 and lower superheat steam is established in the space 68 in an upper portion 69 of the chamber 64, which, in the illustrated drawing, has an enlarged cross-sectional area relative to the lower region 67. Low pressure superheated steam, typically at about 50 to 65 psig, is forced by a blower 72 upward through a conduit 74 that enters the lower end of the chamber 64. The steam flows upward with sufficient force to fluidize the pulping liquor particulates within the lower region 67 of the chamber 64. The fluidized bed of particulates is maintained between a lower grid plate 77 and the upper end of an exit tube 76 through which particulates that overflow from the fluidized bed drop as additional particulates are produced. Pulping liquor from the concentrator 14 (or directly from evaporator 12) is introduced, e.g., by spraying, into the bed 17 from a header 78 connected to the concentrated liquor line 40 disposed just above the grate 77. As the liquor droplets rise through the bed 17, they either contact the particulates, drying thereon and enlarging the particulates, or dry free of existing particulates to form new particulates.

The particulates are dried in the dryer 16 until they are non-tacky and do not stick together. The degree of dryness necessary to achieve non-tackiness depends upon the composition of the liquor, which may depend, for example, on the chemicals used in the wood pulping process. Generally this requires that the water content be reduced to about 10% or less and in most cases to about 8% or less. Pulping liquor may be dried to form particulates having substantially no water, i.e., less than about 1% by weight.

The dryer 16 is selected over other possible types of dryers for several reasons. The agitation of the particulates of the fluidized bed 17 prevents dried solid from agglomerating and clogging the dryer 16, and the agitation of the particulates also tends to dislodge any solid that forms on interior surfaces of the dryer. The particulates of the solid that form in a fluidized bed dryer are especially suitable for burning in the recovery furnace 10.

Importantly, the fluidized particulates impinge upon the heat exchange tubing 20, aiding heat transfer from the tubing to the fluidized bed. In the absence of impinging particulates, a boundary layer would tend to form around the tubing and act as a barrier to heat transfer from the tubing. The continual impingement of the particulates tends to destroy the vapor layer, resulting in a several fold increase in heat transfer efficiency. Furthermore, some heat is transferred by conduction from the tubing walls directly to the impinging particulates.

The major portion of the incoming liquor spray wets particulates that are already formed, and as the additional liquor dries on the particulate surfaces, the particulates increase in size. When the incoming droplets of concentrated liquor contact the particulates, the droplets wet a surface area of the pre-formed particulates that is much greater than the surface area of the droplets themselves. Vaporization of water from the broad, wetted surface of the particulates is much more rapid than evaporation would be from intact droplets with much smaller surface areas.

The larger particulates tend to break apart as a result of the agitation, preventing oversized particulates from forming and providing smaller particulates which grow with continuous addition of liquor. Generally, particulates are removed through the exit tube 76 before becoming oversized. The desired size range of particulates existing in the bed is between about 500 and about 5000 microns and most of these are between about 500 and 2000 microns in diameter. The size of the particulates that are formed depends upon the conditions in the bed, such as temperature. Thus, the size of particulates can be adjusted to accommodate recovery furnace requirements.

The major portion of the heat needed for drying the pulping liquor is supplied by the medium pressure steam from which heat is transfered to the fluidized bed through the heat exchange means 19. Along the extent of the tubing or plating 20 within the dryer 16, condensation of the medium pressure steam occurs, the latent heat of vaporization of the medium pressure steam being converted to sensible heat in the fluidized bed where it effects vaporization of a substantial portion of the water content of the concentrated pulping liquor. The condensate of the medium pressure steam is returned to the boiler drum and superheater section 50 via line 80. Other sources of heat are possible, such as electrical or high temperature flue gas.

Although the low pressure dry (superheated) fluidizing steam introduced through line 74 supplies a relatively small portion of the drying heat, it is considered to be important that the fluidizing steam be above the boiling point of water from the pulping liquor to avoid condensation in the fluidized bed region which would cause agglomeration of the particulates. Therefore, the fluidizing steam is dried in a superheater 82 by heating the steam above the boiling point of water from the pulping liquor. The steam entering the superheater is a portion of the steam leaving the dryer 16 by line 83. In the dryer superheater, medium pressure steam (indirectly) from the boiler drum and superheater section 50 passes through coils 84 that contact the fluidizing steam. The condensate of the medium pressure steam, which has given up its latent heat of vaporization to the fluidizing steam, is also returned via the feedwater system to the boiler drum and superheater section 50.

Drying pulping liquor in a fluidized bed has presented substantial problems with respect to maintaining fluidization of the bed. As noted above, it is much more difficult to maintain a fluidized bed in a dryer in which steam is in contact with pulping liquor solids than with a slurry, such as a slurry of coal particles and water, as described in above-mentioned U.S. Pat. No. 4,295,281. Whereas steam is non-interactive with coal particles, steam interacts substantially with pulping liquor and with pulping liquor solid particulates. Pulping liquor is closer to being a solution than to being a solid or a slurry. Pulping liquor solids substantially lower the steam vapor pressure of the pulping liquor relative to a steam only system and therefore require that drying steam be superheated to a relatively high temperature to boil water from the pulping liquor solids. Pulping liquor solid particulates are hygroscopic, readily absorbing moisture, and the hygroscopic tendency is manifest in tacky, hard to fluidize solid particulates in the presence of steam. An important aspect of the invention is providing conditions whereby a fluidized bed of pulping liquor and pulping liquor particulates is maintained in the presence of steam.

In order to dry pulping liquor in a fluidized bed of pulping liquor and pulping liquor solid particulates, the temperature in the fluidized bed region 67 must be maintained at least at the point that water boils from the pulping liquor. This temperature is substantially higher than the boiling point of water alone at the particular pressure, the difference in boiling temperature of water from the pulping liquor and the boiling point of water alone at the particular pressure being known as the "boiling point rise".

It is found that operating the fluidized bed at too low an operating temperature (and pressure) results in a fluidized bed that pulses and slugs due to agglomeration of tacky pulping liquor solid particulates. On the other hand, operating the fluidized bed at too high a temperature (and pressure) results in pyrolysis of the organic components of the pulping liquor components, in which case, the particulates also agglomerate. Accordingly, the fluidized bed must be operated at temperatures within a relatively narrow range of temperatures (and necessarily within a relatively narrow range of pressure).

The minimum temperature at which the fluidized bed may be maintained is 245° F. to 300° F. The minimum operable temperature for the particular system depends upon the boiling point rise of the particular pulping liquor composition, liquors with higher boiling point rises requiring higher minimum operating temperatures. The major characteristic of the pulping liquor determining its boiling point rise is its alkaline content, particularly its OH content, the more OH being present, the higher the boiling point rise. Assuming a generally consistent amount of alkali used for pulping, the amount of OH present in the pulping liquor is generally primarily determined by the amount of pre-oxidation to which the pulping liquor has been subjected, increased pre-oxidation of the pulping liquor reducing the amount of OH present. Generally for pulping liquors having the highest amounts of OH, e.g., that which has undergone substantially no pre-oxidation, the minimum temperature at which the fluidized bed must be maintained is about 300° F. On the other hand, pulping liquor which has undergone a substantial degree of pre-oxidation and which therefore has a minimal OH content might be dried in a fluidized bed at a minimum temperature of about 245° F. Other alkalis, such as $Na_2S$, may also affect the lower permissible operating temperature.

It is desirable to operate dryer at as low temperature as possible consistent with fluidization of the bed and with the temperature required for boiling water from the particular pulping liquor because higher energy efficiencies are achieved by operating at lower temperature.

Maximum efficiencies of operation are achieved if the fluidizing and drying medium is 100% superheated steam. However, in some cases, the steam may be mixed with up to about 15% v/v of other gases, such as air or flue gas, which do not interact with the pulping liquor solids. The addition of up to about 15% v/v of air or flue gas tends to reduce tackiness of the pulping liquor particulates. The admixture of air or flue gas also enables lower bed temperatures to be used. The addition of minor proportions of non-interacting gases to the superheated steam may be necessary when drying a pulping liquor having a high alkali content with a correspondingly high boiling point rise such that the temperature needed to effect drying would approach the pyrolysis temperature of the organic materials in the pulping liquor solids. Also, admixture of air or flue gas is desirable where only relatively low pressure steam is available, in which case, the admixture of some air or flue gas contributes to the total pressure in the dryer. Air or flue gas may be introduced, for example, through line 99 at the bottom of the dryer where it mixes with superheated steam entering through line 74.

If possible, admixture of air or flue gas to the steam is avoided because it lowers the energy level of the steam produced from the dryer. That is, the steam from the dryer has a high level of non-condensible gases which need to be recovered and recycled back to the fluidized bed.

In order to provide a superheated, drying, steam atmosphere, the pressure in the fluidized bed region is maintained at between 40 and about 70 psig and more generally between about 50 and about 65 psig. The upward velocity of the drying, fluidizing atmosphere must be sufficient to maintain fluidization of the bed, and it is found that the upward velocity of steam needed to fluidize pulping liquor particulates must be at least about 1.9 times that of the velocity of air or flue gas needed to fluidize the same pulping liquor particulates. The need for higher flow velocities is demonstrative of the substantial interaction of steam with the hygroscopic pulping liquor particulates, the higher flow velocities being needed to compensate for the tackiness of the particulates in the presence of steam. The necessity of substantially higher flow velocities is illustrative of the difference in a system in which the fluidizing medium is interactive with the material being dried from a system in which the fluidizing medium is non-interactive with the material being dried.

The entry temperature of the fluidizing steam at the bottom of the dryer is maintained at least about 10° F. higher than the boiling point of water from the pulping liquor at the operational pressure of the dryer 16. For example, if the operational pressure in the dryer is 55 psig, the boiling point of water alone is about 303° F. and the boiling point rise is about 75° F., making it necessary to operate the bed at 378° F., the incoming fluidizing steam is at least about 388° F.

In the space 68 above the bed 17, the lower superheat steam contains some particulates which must be removed before the steam leaves the chamber 64. As one means of separating the particulates from the steam, a set of cyclones 86 are shown in FIG. 3, the steam exiting the tank through lines 88 from the chamber 64, and the particulates returning into the bed 17 via tubes 90 from the cyclones. One advantage of slight particulate tackiness is very low particulate carryover.

The steam from lines 88 is combined in line 91, and a portion of the combined, substantially saturated steam is diverted through the recirculating line 83 for superheating and recyling as the fluidizing steam. The major portion, however, is conducted through line 36 leading to the concentrator 14 (FIG. 1) or through line 61 (FIG. 2) to evaporator 12, as the case may be.

The production of substantial quantities of low pressure, partially superheated steam for use in the upstream concentrators and/or evaporators provides for efficient upstream transfer of heat from the dryer. The process of concentrating and drying pulping liquor is very energy intensive, and a system to have practical utility must efficiently use the available heat. In the system of the present invention, the medium pressure steam gives up its latent heat of vaporization to the concentrated pulping liquor, generating additional amounts of steam. Upstream of the dryer 16, in concentrator bodies 34*a,b* or evaporator effects 13*a'–f'*, latent heat of the vaporization is extracted from the heat as the steam condenses. Because the phase transition from steam to water is isothermal, the concentrator bodies 34*a,b* and evaporator effects 13*a'–f'* each operate at a substantially uniform temperature throughout. Temperature and pressures gradually decrease from effect 13*f* to effect 13*a*. Heat transfer to the upstream concentrator bodies and evaporator effects would be much less efficient if the concentrated liquor in the dryer 16 were dried with a flowing gaseous medium, such as air, that could only transfer sensible heat to the upstream concentrators and evaporators. A sensible heat transfer medium would cool in the upstream concentrator body or evaporator effect, preventing the concentrator body or evaporator effect from operating at a uniform temperature. Furthermore, the volume of a gaseous medium that transfers sensible heat would be so large that it could not be used efficiently in the concentrator or evaporator, and a significant portion of the volume of the medium would have to be discharged, resulting in heat loss from the system.

The use of heat transfer coils/plates 19 within the bed enhances the dryer's 16 performance. Direct high temperature superheated steam could, however, be the only energy supply for liquor drying. If this were practiced, the steam 74 temperature or flow would be excessive in order to prevent condensation as it gave its heat up to the incoming liquor. The compressor 72 would be larger and more costly to operate. The steam 53 would now be the main energy source. It would need to be of higher quality, hence less valuable electrical byproduct could be generated at 52. In addition, this concept would have the fluidizing gas flow directly related to the energy supplied to the bed. Operation and control would be complicated. The use of coils/plates 19 circumvents the above problems. The system as shown in FIG. 3 minimizes the level of the required energy source, reduces the use of electrical power, and provides separate operating control over the fluidizing gas flow and the energy transferred in the bed.

To start up the fluidized bed, liquor is injected into a hot recirculating gas stream flowing through the fluidized bed drying vessel. The hot gas source is either flue gas or air heated indirectly via steam heaters. The gas is charged to the system and recycled via a blower. The inner bed coils and the superheater heat the gas. The temperature of the hot gas reaches between 300° and 375° F. The gas velocity is such that as the liquor droplets dry they do not elutriate from the dryer. This process continues until a sufficient number of particles are generated which constitute the proper fluidized bed volume. Product withdrawal begins after the bed volume is reached.

During this formation process, a portion of the exhaust gases are vented. A second portion is reheated and recycled to the bed. Gas venting begins once the desired system pressure is reached. As evaporation and venting continue, the initial hot gas concentration declines and the water vapor content increases. Once the water vapor (steam) is essentially 100% of the recycled gas, this stream, which had been vented, is now sent directly to the evaporation system. The fluidized bed dryer is started. Flue gas is the preferred start-up gas. This minimizes any sulfide oxidation. For short shutdowns, no inert gas needs to be introduced. Air with a low moisture is the preferred gas to introduce before shutting down. On extended shutdowns all bed material is removed.

EXAMPLE 1

Tests were conducted to determine appropriate conditions for maintaining fluidized beds of black liquor solid particulates. In each case, particulates of pre-dried black liquor solids ranging from 0.5 mm to 2 mm in diameter, were fluidized with upwardly flowing steam and/or air. In each case, fluidization was initiated with air, and then a switch was made to steam or to an air-steam mixture. The temperature was also varied to determine the effects of different temperatures on fluidized beds. Black liquor solid particulates of two different compositions were used, composition A having a NaOH concentration of 0.16% by weight of the dried solids and composition B having a NaOH concentration of 0.90% by weight of the dried black liquor solids. The results of four tests are described as follows, and the test data is listed in Table 1 below.

In test 1, part 1, dried black liquor solids A were first fluidized in a hot air stream without difficulty. Parts 2 and 3 are duplicate tests with superheated steam fluidization. In order to achieve good fluidization, sufficient steam was added to raise the superficial gas velocity from 3.7 ft/s (the acceptable velocity for air) to over 6.1 ft/s (the minimum for steam under test conditions). The flow exceeded the rotameter scale readings. Lower flows did not produce good fluidization for steam. The bed remained fluid throughout the test. The test was stopped to obtain samples.

In test 2, part 1, dried black solids B were first fluidized in air at the conditions shown in Table 1. Significant difficulties were encountered when the bed exceeded 375° F. in that it became tacky and defluidized. This duplicated an earlier observation. When the switch to steam was made, defluidization occurred. Lumps had to be broken up and the system refluidized with air. This happened at least four times before the proper transition technique was used. Part 2 shows that with 85% v/v steam and 15% v/v air, solids B can be fluidized. The total fluidizing velocity was 6.4 ft/s. At a steam velocity over 6.1 ft/s, the solids were fluidized with 100% steam in Part 3. In this case, however, when the temperature reached 325° F., the particles agglomerated and the bed defluidized.

Tests 3 and 4 were done to confirm the results of tests 1 and 2 and to obtain an accurate measure of the steam flow. The float in the steam rotameter was changed to increase its rated capacity, enabling a quantitative measurement of the higher steam flows.

Test 3, part 1, repeated test 1, part 1 with solids A. When the bed temperature rose to 390° F., the solids become tacky and the bed defuidized. Below this temperature there were no problems.

In Test 3, part 2 no problems were encountered when the switch was made to superheated steam down to a temperature of 265° F. Below this level, the bed began to pulse and slug. This became very pronounced at 248° F. At 245° F. complete defluidization occurred. The steam velocity during this time ranged from 7.3 to 7.5 ft/s, significantly higher than that required with air.

In test 4, part 1, air fluidization of the black liquor solids B was repeated. Again, in switching to steam there were difficulties because of the manual controls involved. The bed agglomerated and defluidized. Parts 2 and 3 are repeat tests that show conditions under which superheated steam fluidization of normal black liquor solids can occur. In both cases the required steam velocity was high, 7.5 ft/s. Defluidization occurred when the material became tacky at approximately 300° F. Until that time the bed exhibited good fluidization characteristics.

TABLE 1

Fluidization Tests With Black Liquor Solids
(Initial particle size for all work - 2 mm + 0.5 mm + 0.5 mm in diameter)

| Test-Part No. | Bed Solids | Bed Temperature (°F.) | Air (@ Temperature) Flow ($ft^3/m$) | Air (@ Temperature) Velocity (ft/s) | Steam (@ Temperature) Flow ($ft^3/m$) | Steam (@ Temperature) Velocity (ft/s) | Pressure Drop in $H_2O$ | Comments |
|---|---|---|---|---|---|---|---|---|
| 1-1 | BLS A | 340 | 20 | 3.7 | 0 | 0 | 1.6 | Good fluidization. No agglomeration or slugging. |
| 1-2 | BLS A | 340 to 315 | 0 | 0 | +32 | +6.1 | 1.2 | Good fluidization. Did not slug or defluidize. |
| 1-3 | BLS A | 345 to 285 | 0 | 0 | +32 | +6.1 | 1.2 | Good fluidization. Did not defluidize. Still fluid at end. |
| 2-1 | BLS B | 375 | 11 | 2.1 | 0 | 0 | 0.8 | Good fluidization. |
| 2-2 | BLS B | 355 to 340 | 4.9 | 0.9 | 29 | 5.5 | 0.8 | Good fluidization. Did not slug or defluidize. |
| 2-3 | BLS B | 375 to 325 | 0 | 0 | +32 | +6.1 | 0.8 | Good fluidization. Did set up and become tacky, defluidizing at end. |
| 3-1 | BLS A | 375 | 21 | 3.9 | 0 | 0 | 1.2 | Good fluidization. |
| 3-2 | BLS A | 375 to 265 | 0 | 0 | 40 | 7.5 | 1.2 | Good fluidization over entire T range |
| | | 265 to 245 | 0 | 0 | 39 | 7.3 | 1.2 | Slight slugging began to occur. Complete defluidization at end. |
| 4-1 | BLS B | 370 | 21 | 3.9 | 0 | 0 | 0.8 | Good fluidization. |
| 4-2 | BLS B | 350 to 302 | 0 | 0 | 40 | 7.5 | 0.8 | Good fluidization until very close to end. Defluidizaton at end. |
| 4-3 | BLS B | 320 to 297 | 0 | 0 | 40 | 7.5 | 0.6 | Again good fluidization until very end. Defluidized at end. |

The tests illustrate the distinctive characteristics of steam fluidization of black liquor solids. First, there is an upper temperature bound of between 375° to 390° F.

Above this temperature, the solids become tacky, even in air, indicating the onset of pyrolysis. Second, simply replacing air with superheated steam does not produce the same fluidization pattern. Velocity correlations would predict that because steam is lighter than air, the velocity should increase by a factor of 1.3, but in fact, a velocity increase by a factor of 1.9 was required. The higher velocity requirement is because of the tacky nature of the solids. Without the increased aggitation, the bed would defluidize. Third, there is a lower temperature limit for the bed which is above the saturation temperature for the steam. This varies with the solids type. The solids A limit is 245° F. while the solids B limit is 300° F. The key variable influencing the lower limit is thought to be the residual alkali (NaOH and $Na_2S$) content of the liquor. In particular, the level of NaOH appears key. Lower temperature limits do not exist for non-interactive systems, such as coal in steam or black liquor solids in air. Fourth, the admixture of some air with the steam can stabilize the operation until the proper conditions are obtained. The addition of 15% v/v air reduced the tacky tendency. Some air admixture enables operation at lower bed temperatures much like the change of residual alkali. The lack of sulfide in either of these liquors shows that the process can be applied to Soda process liquors as well as Kraft process liquors.

EXAMPLE 2

In the dryer 16, concentrated black liquor at 75.7 percent solids is dried to form a solid in particulate form having a solids concentration of 95%, and the steam generated in the dryer transferred to 2-body concentrator 14 where the latent heat of the steam is used to increase the solids content of the liquor from 55 to 75.7 percent. The dryer 16 is operated at 65 psig, whereat the saturated steam temperature is 312° F. Recirculating steam in line 83 is heated in the superheater 82 having coils 84 through which 448° F. saturated steam flows. 448° F. steam also flows through the tubing 20 which transfers heat to the fluidized bed 17 in order to maintain a temperauture of 387° F. or above in the region of the fluidized bed 17. In the space 68 above the fluidized bed 17, the steam temperature is 330° F. or higher. A portion of the steam passing out of the space 68 is recircuiated through line 74 and reheated in the superheater 82 while the reminder of the steam is utilized in the upstream concentrator 14 wherein supplies all of the heat needed to concentrate the liquor. Flows are analogous to FIG. 1.

Table 2 below shows the performance of the system.

TABLE 2

| | Concentrator(2-Body) | Fluidizer Bed Dryer |
|---|---|---|
| Inlet solids (weight percent) | 55 | 75.7 |
| Outlet solids (weight percent) | 75.7 | 95 |
| Evaporation (wt. $H_2O$ evaporated/wt. black liquor solids) | 0.50 | 0.27 |
| Steam economy (wt. $H_2O$ evaporated/wt. steam) | 1.85 | 0.64 |
| Steam economy (weighted average of concentrator and dryer) | 1.81 | |
| Steam Required (weight of steam from furnace/weight of black liquor solids) | 0 | 0.42 |

TABLE 2-continued

| | Concentrator(2-Body) | Fluidizer Bed Dryer |
|---|---|---|
| of black liquor solids) | | |

EXAMPLE 3

A fluidized bed dryer 16' is used in the system illustrated in FIG. 2, and the dryer is operated under the conditions described in Example 1; however, in this case, the excess steam generated in the fluidized bed dryer 16' supplies all of the heat needed to concentrate black liquor as it flows through a 6-effect evaporator 12 from 15% solids to 50% solids, at which concentration the liquor is introduced directly into the dryer 16.

The performance of the system is illustrated in Table 3 below:

TABLE 3

| | 6 Effect Evaporator | Fluidizer Bed Dryer |
|---|---|---|
| Inlet solids (weight percent) | 15 | 50 |
| Outlet solids (weight percent) | 50 | 95 |
| Evaporation (wt. $H_2O$ evaporated/wt. black liquor solids) | 4.68 | 0.94 |
| Steam economy (wt. $H_2O$ evaporated/wt. steam) | 50 | 0.71 |
| Steam economy (weighted average of concentrator and dryer) | 4.25 | |
| Steam Required (weight of steam from furnace/weight of black liquor solids) | 0 | 1.32 |

The advantages of the method of the present invention are best illustrated by way of the increased efficiencies that are achieved. Because the solid is a higher quality fuel than concentrated liquor, thermal efficiency of the recovery boiler is increased at least form approximately 67% to about 75%. The combustion process within the furnace is also improved, possibly increasing productivity even further. Further efficiencies are achieved by the ability to store the solid particulates until needed for combustion in the recovery furnace, thereby allowing the furnace to operate at a generally uniform and optimal rate, and permitting use of a smaller furnace.

Although the invention has been described in terms of certain preferred embodiments, modifications obvious to one with ordinary skill in the art may be made without departing from the scope of the present invention. For example, not shown but conventional in the art is a wet oxidizing unit which oxidizes the pulping liquor to reduce its chemical oxygen demand by about 1 to about 3 percent, converting sulfides to sulfates to minimize noxious emissions from the recovery furnace. Further wet oxidation that reduces the chemical oxygen demand by about 5 to about 25% may be used to produce a solid which is non-hygroscopic.

Various features of the invention are set forth in the following claims.

What is claimed is:

1. A method of preparing non-tacky pulping liquor solid particulates comprising concentrating pulping liquor to between about 50 and about 75 weight percent solids, the balance being essentially all water, providing a pressurized drying vessel having a region and containing a bed of pre-formed pulping liquor solid particulates within said region, within said region, fludizing said bed of particulates with a gaseous medium stream, comprised of at least about 85% v/v superheated steam, balance non-interactive gases, said medium flowing upwards through said bed of particulates at a sufficient velocity to fluidize said particulates, said velocity being at least about 6.1 feet per second, introducing said pulping liquor into said fluidized bed, maintaining the temperature within said fluidized bed region at, at least, the boiling temperature of water from the pulping liquor at the pressure within said pressurized vessel, the temperature in said region not to exceed a maximum temperature of between about 375° F. to about 390° F., above which organic components of said pulping liquor tend to pyrolyze and not to drop below a minimum temperature of between about 245° F. and about 300° F., below which pulping liquor solid particulates aggregate in the presence of steam, the pressure in said vessel being between about 40 and about 70 psig, the temperature and pressure being such that water boils from said pulping liquor, the major portion of the thermal energy for maintaining said temperature being provided by passing steam at such elevated temperatures and pressures through heat-exchange means within said pressurized region that the steam in said heat-exchange means condenses, releasing its latent heat as sensible heat that is transferred to said fluidized bed region, whereupon said gaseous medium vaporizes water from the pulping liquor with said region, creating additional solid particulates and substantially lowering superheat of said stream of gaseous medium, said gaseous medium stream being introduced at a temperature at least about 10° F. higher than the temperature maintained within said fluidized bed, continuously withdrawing solid particulates from said fluidized bed so as to maintain the size range of bed particulates at between about 0.5 and about 5.0 mm in diameter, the residence of black liquor in said fluidized bed being sufficient to produce particulates having less than about 10% water content, withdrawing said lower superheat gaseous medium from said vessel, directing a portion of said withdrawn medium through a superheater and recirculating the same as said fluidizing medium, and utilizing another portion of said withdrawn medium in said concentrating step.

2. A method according to claim 1 wherein said pulping liquor is concentrated to at least about 50 weight percent solids in a multiple effect evaporator.

3. A method according to claim 1 wherein said pulping liquor is concentrated to at least about 50 weight percent solids in an evaporator and subsequently concentrated to at least about 65 weight percent solids in a concentrator.

4. A method according to claim 1 wherein said solid particulates that are formed have at least about 99 weight percent solids.

5. A method according to claim 1 wherein a substantial portion of said withdrawn, lower superheat gaseous medium is utilized in said concentrating step.

6. A method according to claim 1 wherein said gaseous medium stream is 100% superheated steam.

7. A method according to claim 1 wherein the rate of particulate withdrawal from said fluidized bed is sufficient that most of the particulates within said bed are between 0.5 and 2 mm in diameter.

8. A method according to claim 1 wherein the flow rate of the fluidizing stream is about 7.5 feet per second.

9. A method according to claim 1 including pre-oxidizing the black liquor prior to spraying it into said fluidized bed, thereby reducing the alkaline content of the black liquor and reducing the minimum temperature required to maintain fluidization of the particulates within said fluidized bed.

* * * * *